US008601734B1

(12) United States Patent
Hopkins et al.

(10) Patent No.: US 8,601,734 B1
(45) Date of Patent: Dec. 10, 2013

(54) PIVOTING FIREARM HANDGRIP

(71) Applicants: Charles Tyler Hopkins, Winslow, ME (US); Charles Anthony Hopkins, Winslow, ME (US)

(72) Inventors: Charles Tyler Hopkins, Winslow, ME (US); Charles Anthony Hopkins, Winslow, ME (US)

(73) Assignee: Alcor Scientific, Inc., Smithfield, RI (US)

( * ) Notice: Subject to any disclaimer, the term of this patent is extended or adjusted under 35 U.S.C. 154(b) by 0 days.

(21) Appl. No.: 13/743,464

(22) Filed: Jan. 17, 2013

(51) Int. Cl.
*F41C 23/00* (2006.01)

(52) U.S. Cl.
USPC ..... 42/73; 42/71.01

(58) Field of Classification Search
USPC ..... 42/73, 71.01, 71.02
See application file for complete search history.

(56) References Cited

U.S. PATENT DOCUMENTS

| | | | | |
|---|---|---|---|---|
| 2,826,848 | A | 3/1958 | Davies | |
| 4,300,302 | A | 11/1981 | Anschutz et al. | |
| 5,417,002 | A | 5/1995 | Guerra | |
| 5,946,842 | A | 9/1999 | Nyzell et al. | |
| 7,322,142 | B1 | 1/2008 | Leung | |
| 7,325,351 | B1 | 2/2008 | Leung | |
| 7,823,855 | B2 | 11/2010 | Faifer | |
| 2009/0193702 | A1 | 8/2009 | Lin | |
| 2010/0146836 | A1* | 6/2010 | Moody et al. | 42/72 |
| 2011/0197488 | A1* | 8/2011 | Carr et al. | 42/73 |

FOREIGN PATENT DOCUMENTS

| | | |
|---|---|---|
| GB | 209367 | 1/1924 |
| WO | 2004015355 A2 | 2/2004 |

OTHER PUBLICATIONS

Classic Arms Inc.: Title: Ergonomic Ambidextrous 5-position Foldable Foregrip, URL: http://www.classicarms.us/accessories.htm—Accessed: Jan. 23, 2012.

Zahal Online Store: Title: Tactical Bipod Pivoting Foregrip (2nd Generation), URL: http://www.zahal.org/products/tactical-bipod-foregrip-2nd-generation?path_parent_218295—Accessed: Jan. 23, 2012.

* cited by examiner

*Primary Examiner* — J. Woodrow Eldred
(74) *Attorney, Agent, or Firm* — Barlow, Josephs & Holmes, Ltd.

(57) ABSTRACT

A pivoting firearm handgrip allows a user to pivot the handgrip relative to the firearm into various locked positions. The pivoting handgrip includes a grip base and a grip body that are selectively locked together by a spring biased shaft having key formations. The key formations on the shaft engage keyway formations on finger structures of the grip body. The key structures of the shaft also selectively engage locking formations on supporting structures on the grip base. A spring is captured between the head portion of the shaft and the grip body so that the key formations of the shaft are spring biased to engage the locking formations of the grip base. In use, a user depresses one end of the shaft to disengage the key formations of the shaft from the locking formations of the grip base, and then freely pivots the grip body about the base.

6 Claims, 7 Drawing Sheets

PIVOTING FIREARM HANDGRIP

BACKGROUND

The instant invention relates to firearm handgrips and more particularly to a pivoting handgrip for a firearm.

Traditional firearm handgrips are rotationally fixed to a firearm, limiting the ability of the user to comfortably orient the handgrip. Because a user may desire to have a handgrip rotated to a different position relative to the firearm, there is a need for a pivoting firearm handgrip.

SUMMARY OF THE INVENTION

The instant invention provides a pivoting firearm handgrip that allows a user to adjust the rotational orientation of a handgrip with respect to a firearm. The pivoting adjustment action can be performed with one hand by depressing a spring-biased shaft so that it is moved out of a locked position and then rotating the handgrip up to 30° to either side of said base. The user then releases the spring-biased shaft so that it may return to a locked position, securing the handgrip's orientation with respect to the firearm.

To make the pivoting handgrip of the present invention easily attachable to a firearm, the grip base has an upper surface that is configured for mounting to a firearm using a conventional threaded fastener commonly used in replacement firearm handgrips. This allows the handgrip of the present invention to be provided on a firearm delivered from a manufacturer or provided as an aftermarket handgrip replacement, which the consumer may then easily secure to a firearm.

In order to mount the pivoting grip body on the grip base, supporting structures extend downwardly from the grip base and finger structures extend upwardly from the grip body towards the base structure, so that the supporting structures and finger structures are interleaved. The grip base and grip body are secured together by a shaft supported by and extending through the support structures and finger structures.

The locking action of the present invention is provided by key formations on the shaft. The key formations on the shaft engage complementary keyway formations on the finger structures of the grip body, thus allowing the shaft to rotate with the grip body. The key formations on the shaft also selectively engage complementary locking formations on the grip base, thus allowing the shaft to rotationally lock the grip body to the grip base. The shaft may be displaced along its axis between a normal, spring-biased locked position and an unlocked position. In the normal locked position, the key formations of the shaft engage the locking formations on the supporting structures of the grip base, to prevent the grip body from pivoting relative to the grip base. In the unlocked position, the key formations are disengaged from the locking formations, to allow the grip body to pivot relative to the grip base.

The spring bias of the shaft is provided by a spring captured between the head portion of the shaft and the grip body. The tail portion of the shaft has a shoulder that rests against the grip body in the spring biased position.

The shaft may be formed from an inwardly threaded shank forming the tail portion and an outwardly threaded shank forming the head portion.

Accordingly, among the objects of the instant invention are: the provision of a firearm handgrip that is capable of pivoting about a firearm to which it is secured.

It is further an object of the instant invention to provide a firearm handgrip that is releasably lockable in a plurality of rotational positions by way of a spring biased shaft that has key formations that engage keyways and locking formations on a grip body and a grip base, respectively.

It is further an object of the instant invention to provide a firearm handgrip that is capable of pivoting up to 30° either clockwise or counterclockwise with respect to a firearm, and locking in those positions as well as in a normal center position and a plurality of intermediate positions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
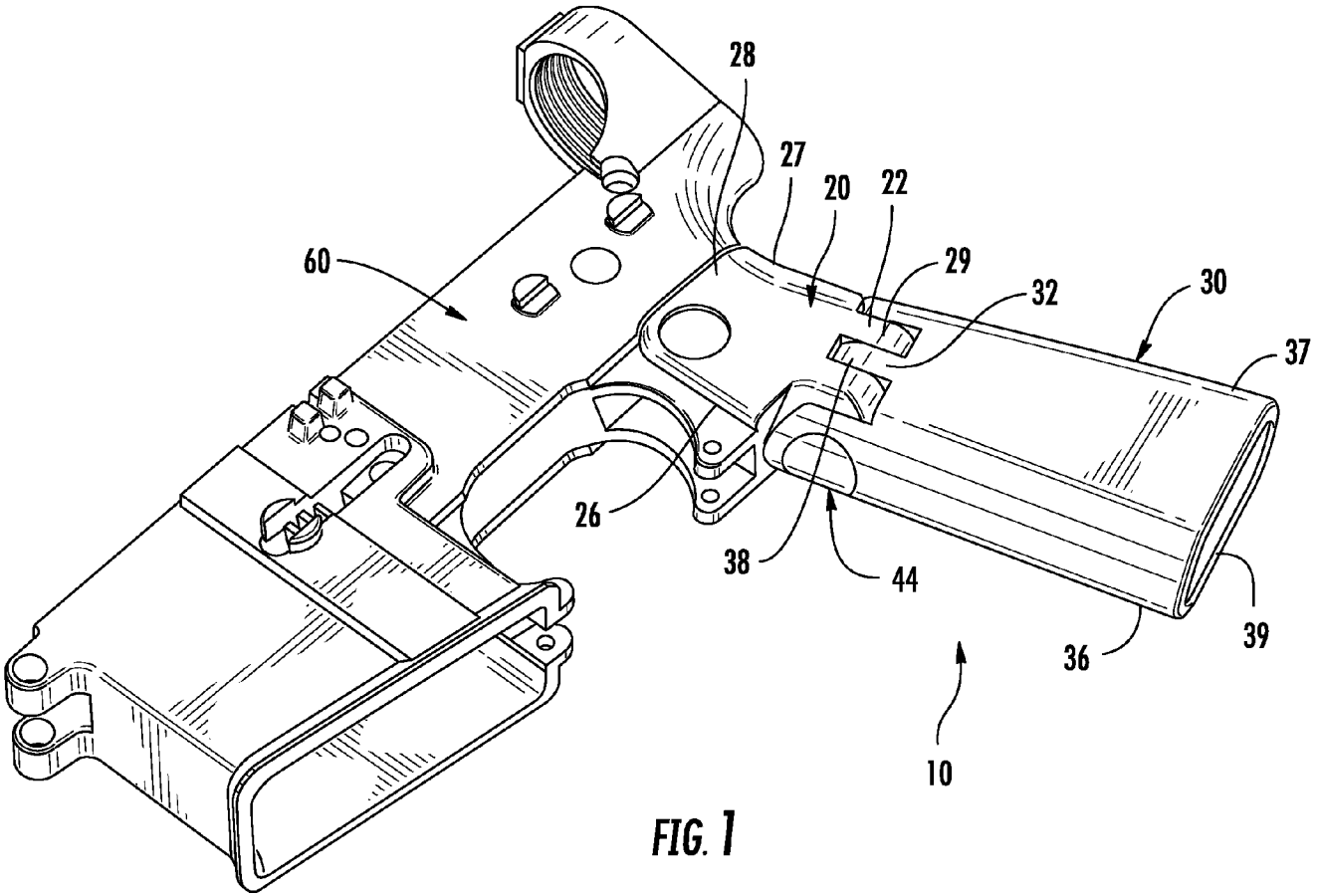
FIG. 1 shows a perspective view of a fully assembled pivoting firearm handgrip constructed in accordance with the invention and mounted on a lower receiver of a firearm.

Referring now to the drawings, the pivoting firearm handgrip of the instant invention is illustrated and generally indicated at 10 in FIGS. 1-7.

When operating a firearm, a user may desire to adjust the orientation of the handgrip relative to the firearm. The pivoting firearm handgrip of the present invention allows the user to easily rotate a firearm handgrip from one locked position to another locked position, thus enabling the user to more comfortably grip the firearm. As will hereinafter be more fully described, this is accomplished by way of a spring biased shaft that has key formations that engage keyway formations on a handgrip body and locking formations on a handgrip base.

Figure 2:
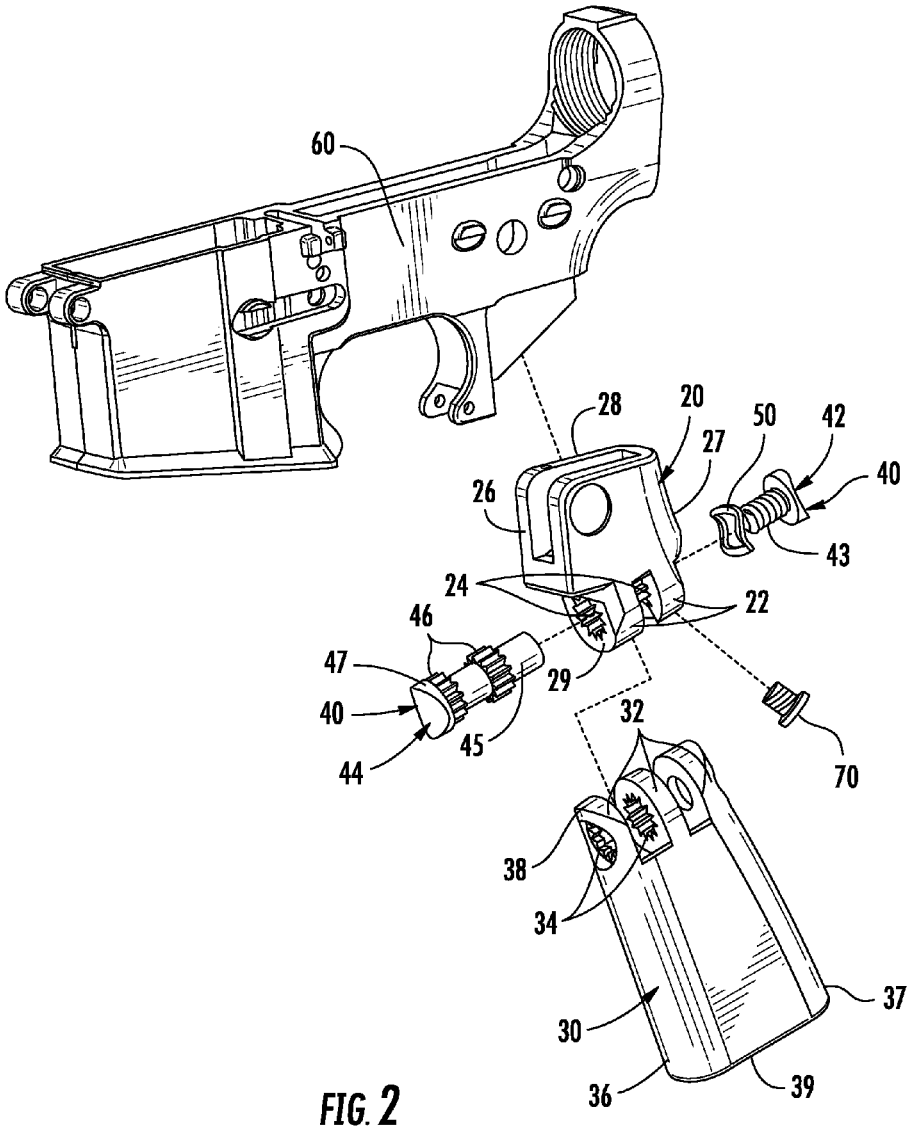
FIG. 2 shows an exploded view thereof.

In the exemplary embodiment, the pivoting firearm handgrip 10 of the present invention is used in conjunction with a rifle, and may be mounted on the lower receiver thereof 60, such as the one shown in FIGS. 1 and 2. As will be described herein, the handgrip 10 may be secured to the receiver 60 by a threaded fastener 70, as shown in FIG. 2.

The exploded view of the present invention provided in FIG. 2 shows in more detail how the pivoting firearm handgrip 10 may be fully assembled.

The handgrip 10 includes a grip base 20 that is configured and arranged for mounting to a handgrip receiver 60. The grip base 20 has a front 26 and a rear 27 as well as an upper end 28 and a lower end 29. A user may secure the upper end 28 of the grip base 20 to the receiver 60 by way of the threaded fastener 70, which passes through an aperture 23 in the upper end 28 of the grip base 20 into a threaded hole (not shown) on the receiver 60. Such threaded fasteners are commonly used to secure firearm handgrips to firearms. Other fasteners used to secure handgrips to firearms may also be used, and do not depart from the scope of this invention.

Once the grip base 20 is secured to the firearm 60, a user may then secure a grip body 30 to the grip base 20. The lower end of the grip body 30 comprises a handgrip, and may incorporate additional design features. This handgrip may be selected from various designs used for firearm handgrips. For example, the grip body may vary for left and right handed users, or may include additional features to add texture. Grip body embodiments other than the grip body 30 shown in FIGS. 1-7 are considered to be within the scope of this invention.

Pivoting attachment of the grip body 30 to the grip base 20 is accomplished by way of spaced apart supporting structures 22 that extend downwardly from the grip base 20. These supporting structures 22 engage spaced apart finger structures 32 that extend upwardly from the upper end 38 of the grip body 30. The supporting structures 22 and finger structures 32 are interleaved, as shown in FIG. 1. The supporting structures 22 and finger structures 32 are designed to have a small tolerance when interleaved that allows the grip body 30 to pivot relative to the grip base 20, but substantially limits the ability of the grip body 30 to move from front to rear along its longitudinal axis.

The grip base 20 and grip body 30 are then held together by way of a shaft generally indicated at 40 extending through them. Both the supporting structures 22 and the finger structures 32 define apertures through which a shaft 40 may be placed. When these apertures are in alignment, a tail portion 44 of the shaft 40 is inserted through the supporting structures 22 and finger structures 32 from the front side 36 of the grip body 30. Next, a spring is placed around the aperture at the rear 37 of the grip body, so that it is in facing engagement with an annular recessed surface 33 on the grip body. Then, a head portion 42 of the shaft 40 is inserted through the supporting structures 22 and finger structures 32 from the rear side 37 of the grip body 30. The head portion 42 is then secured to the tail portion 44 by way of an externally threaded shank portion 43 on the head portion 42 that engages an internally threaded shank portion 45 on the tail portion 44. When the shaft 40 is fully assembled, it has a central axis that is in substantial alignment with the longitudinal axis of the grip body 30.

The locking function of the present invention is achieved by way of spaced key formations 46 on the tail portion 44 of the shaft 40 that engage complementary keyway formations 34 on the finger structures 32 of the grip body 30, and that engage complementary locking formations 24 on the supporting structures 22 of the grip base 20. The key formations 46 and the keyway formations 34 are designed such that they are always engaged in the fully assembled pivoting handgrip. Thus, rotation of the grip body directly rotates the shaft 40 by way of the key formations and keyway formations. The key formations 46 and the locking formations 24 are designed such that they may be selectively disengaged by the user. Thus, the user may disengage the key formations 46 and the locking formations 24 in order to rotate the grip body 30 about the grip base 20.

Figure 3:
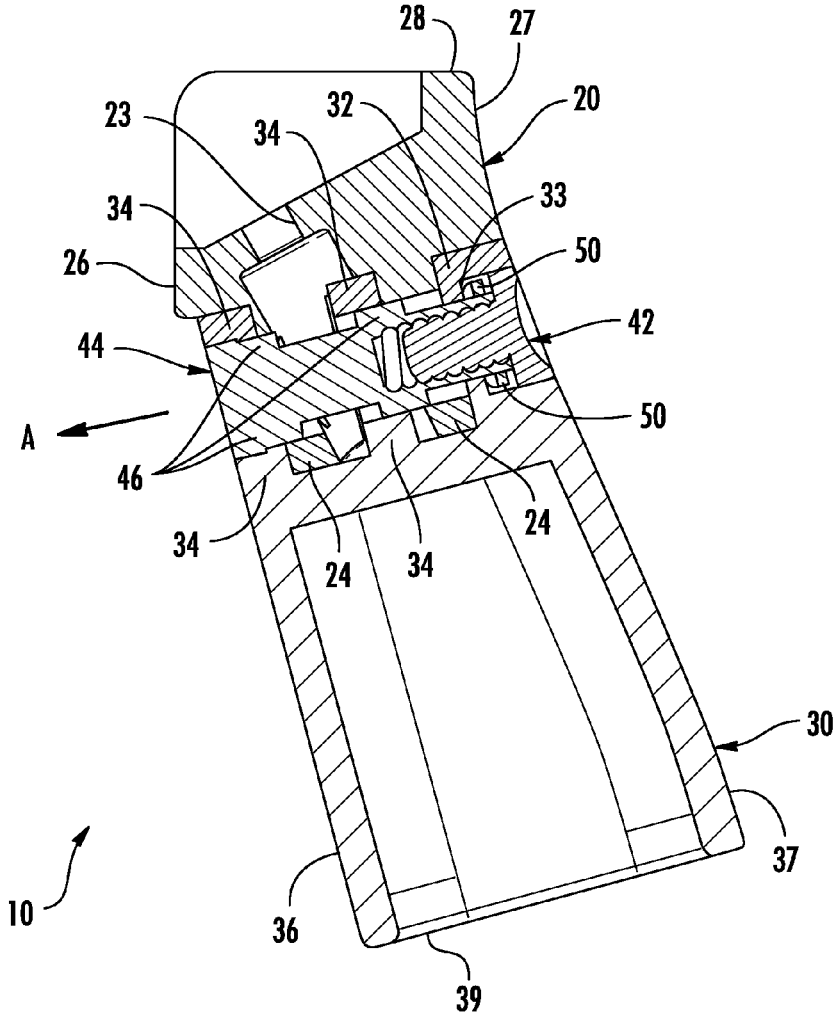
FIG. 3 shows a cross section of the pivoting firearm handgrip in the locked position.

This selective disengagement process is made possible by a wave spring 50 that is captured between the head portion 42 of the shaft and the rearwardmost finger structure 32 on the grip body 30. In the normal locking position, as shown in FIG. 3, the spring 50 pushes the head portion 42 rearwardly away from the grip body 30. At the other end of the shaft, the tail portion 44 includes a shoulder 47 that engages the forwardmost finger structure 32 on the grip body 30 to prevent the shaft 40 from moving relative to the grip body 30. In this spring biased position, the key formations 46 of the tail portion 44 engage both the keyway formations 34 of the finger structures 32 of the grip body 30 and the locking formations 24 of the supporting structures 22 of the grip base 20.

Figure 4:
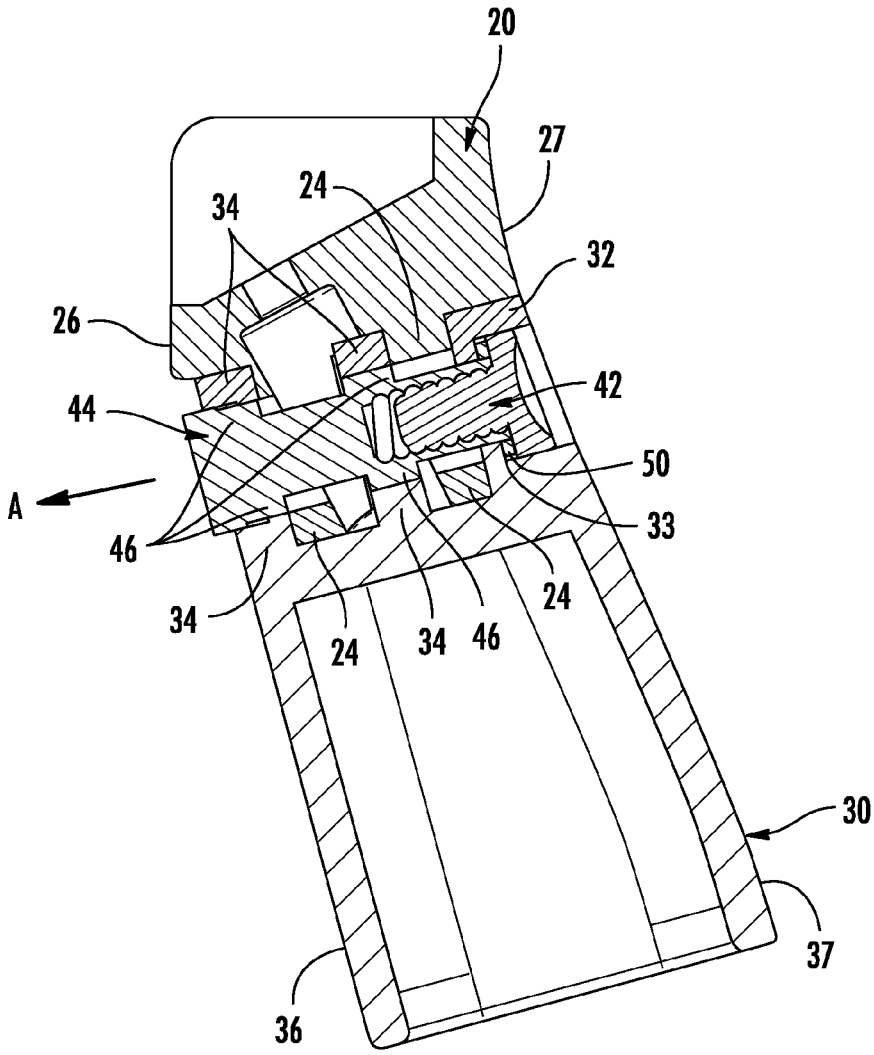
FIG. 4 shows a cross section of the pivoting firearm handgrip in the unlocked position.

When a user depresses the head portion 42 of the shaft against the bias of the spring 50, as shown by arrow A along the central axis of the shaft 40 in FIGS. 3 and 4, the spring 50 is compressed between the head portion 42 and the annular recessed surface 33 of the grip body 30, as shown in FIG. 4. Here, the key formations 46 still engage the keyway formations 34 of the grip body 30, but no longer engage the locking formations 24 of the grip base 20. Thus, the user may rotate the grip body 30 relative to the grip base 20, about the central axis of the shaft.

Figure 5:
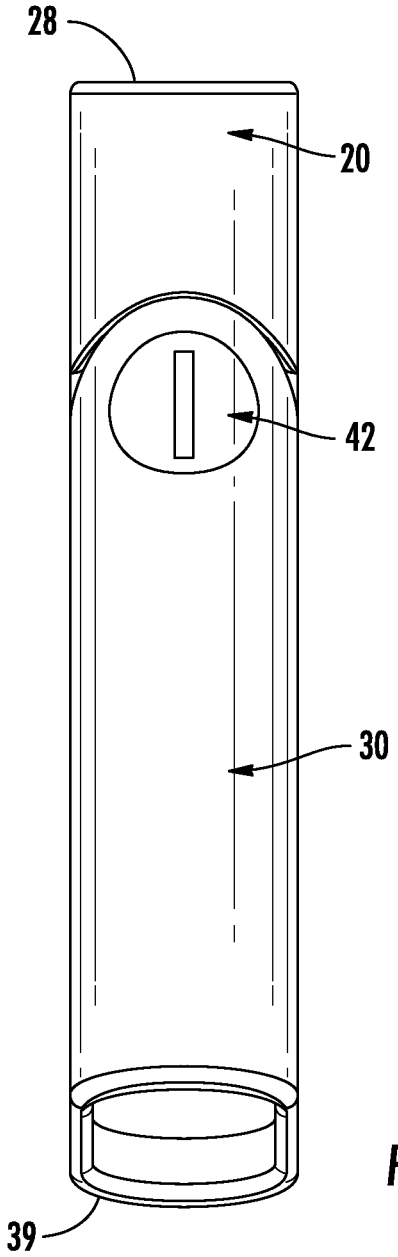
FIG. 5 shows a rear view of the pivoting firearm handgrip in the normal center orientation.
Figure 6:
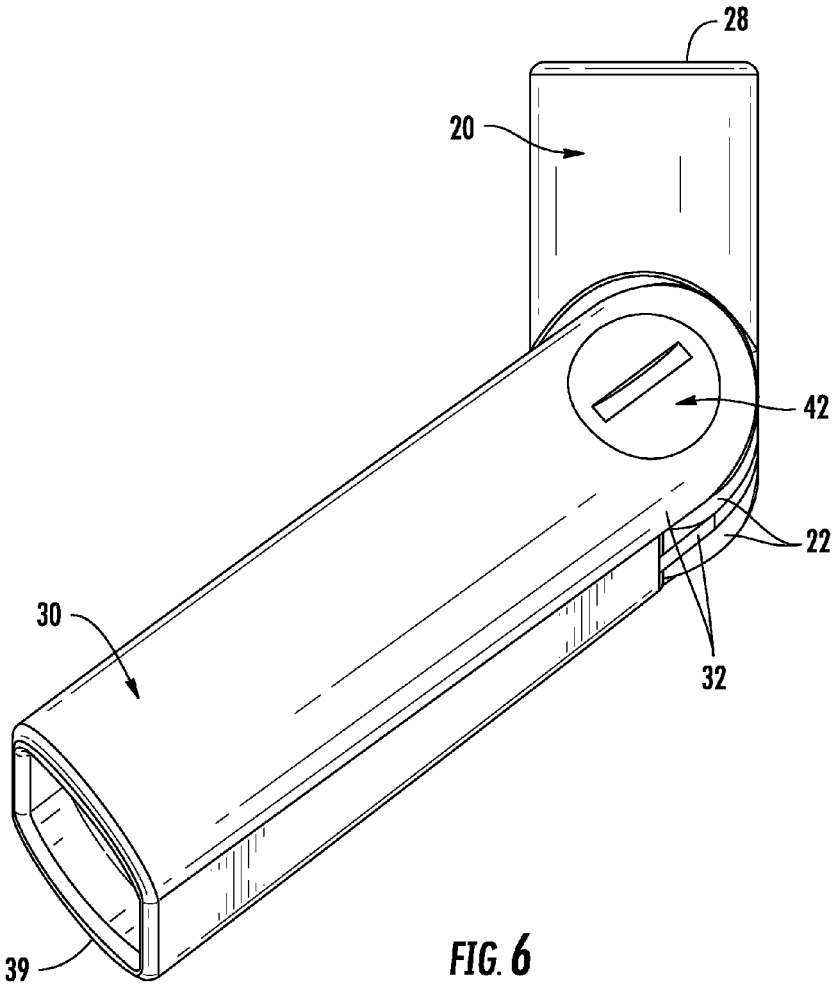
FIG. 6 shows a rear view of the pivoting firearm handgrip pivoted 30° to the left.
Figure 7:
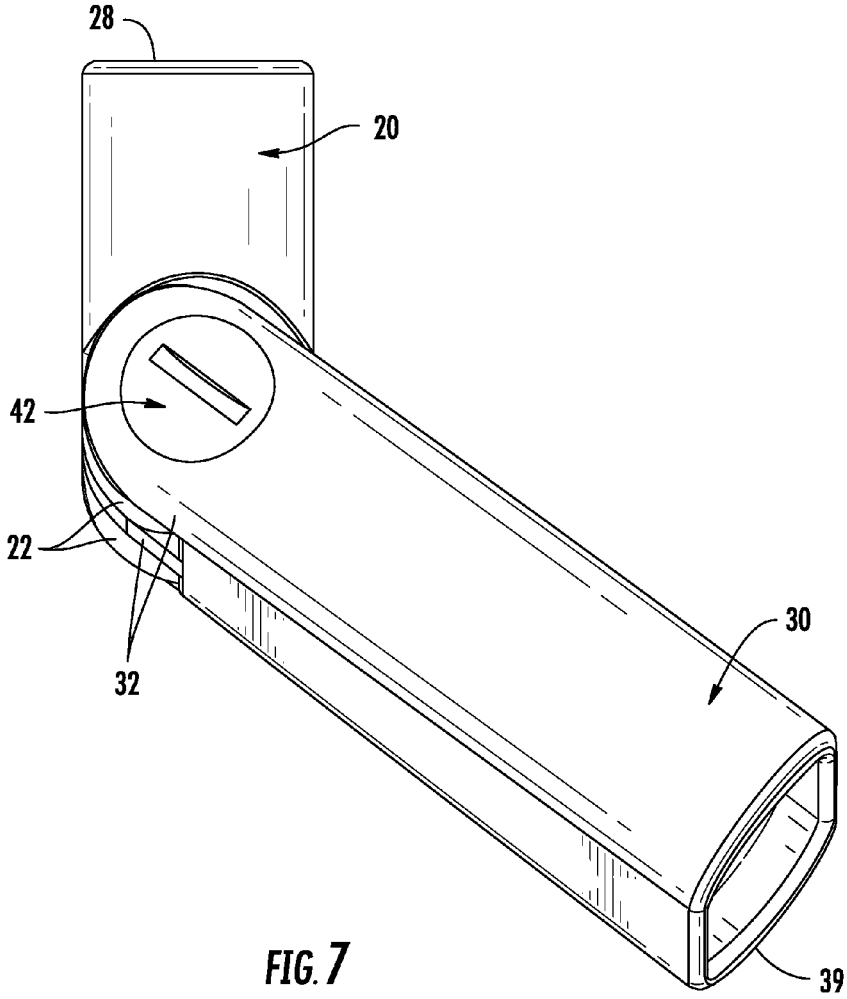
FIG. 7 shows a rear view of the pivoting firearm handgrip pivoted 30° to the right.

The grip body 30 is designed to have a normal center position, where the grip body 30 is in substantial alignment with the grip base 20, as shown in FIG. 5. The grip body may pivot up to 30° about the central axis of the shaft to either side. FIGS. 6 and 7 show how the grip may be pivoted to a locking position that is 30° to either side of the grip base.

In the embodiment shown in FIGS. 2-4, the rearwardmost finger structure 32 does not have a keyway formation 34. In alternate embodiments, it may have a keyway formation to provide additional stability.

Although the grip base is shown with two supporting structures 22, and the grip body is shown with three finger structures 32, more or fewer supporting structures 22 or finger structures 32 may be used without departing from the scope of this invention. For example, there could be two finger structures 32 and one supporting structure 22. Alternatively, there could be more supporting structures 22 than there are finger structures 32, and the spring 50 could be captured between the head portion of the shaft 40 and a supporting structure 22, rather than a finger structure 32.

The key formations 46 and locking formations 24 may be constructed and arranged to lock the grip body 20 in the normal center position of FIG. 5 and the 30° angled positions of FIGS. 6 and 7, as well as many intermediate positions between the extreme 30° positions. For example, the locking formations 24 of FIG. 2 show various possible locking positions based on the number of locking formations 24 along the circumference of the aperture defined on each supporting structure 22. By increasing or decreasing the density of these locking formations along the circumference of these apertures, more or fewer locking positions may be provided. The exemplary embodiment has five locking positions, though other embodiments may have more or fewer locking positions.

The head portion 42 of the shaft is provided in the form of a barrel nut, as shown in FIG. 2. However, other embodiments of head portion 42 are possible and do not depart from the scope of the present invention.

Although the embodiment shown in FIGS. 1 and 2 is shown with a rifle handgrip receiver, the handgrip of the present invention may be used with other weapons such as, for example, a grenade launcher or alternatively may be embodied in a standalone forward hand grip.

Finally, the spring 50 is shown in FIG. 2 as a wave spring. Wave springs of various shapes may be used in place of the wave spring shown. Additionally, a coil spring or another spring design may be used in place of the wave spring without departing from the scope of the present invention.

It can therefore be seen that the present invention provides a firearm handgrip that is capable of pivoting about a firearm to which it is secured; provides a firearm handgrip that is releasably lockable in a plurality of rotational positions by way of a spring biased shaft that has key formations that engage keyways and locking formations on the grip body and the grip base, respectively; and provides a firearm handgrip that is capable of pivoting up to 30° either clockwise or counterclockwise with respect to a firearm, and locking in those positions as well as in a normal center position and a plurality of intermediate positions. For these reasons, the instant invention is believed to represent a significant advancement in the art which has substantial commercial merit.

While there is shown and described herein certain specific structure embodying the invention, it will be manifest to those skilled in the art that various modifications and rearrangement of the parts may be made without departing from the spirit and scope of the underlying inventive concept and that the same is not limited to the particular forms herein shown and described except insofar as indicated by the scope of the appended claims.

What is claimed is:

1. A firearm handgrip comprising:

a grip base having a front and a rear and a longitudinal axis extending between said front and said rear, said grip base further having an upper end and a lower end, said upper end being configured and arranged for mounting to a firearm, said lower end having spaced supporting structures extending downwardly therefrom;

a shaft supported by and extending through said supporting structures, said shaft having a central axis that is in substantial alignment with said longitudinal axis;

a grip body having a lower end and an upper end, said lower end comprising a handgrip, said upper end having spaced finger structures extending upwardly therefrom, said finger structures being configured to be received about said mounting shaft and to be interleaved between said supporting structure wherein said grip body is pivotable about said mounting shaft relative to said supporting structures, said shaft and said finger structures of said grip body having complementary key and keyway formations such that said shaft pivots with said grip body, said supporting structures of said grip base further having locking formations which are complementary to said key formations on said shaft, said shaft being linearly displaceable along said central axis between a normal locked position wherein said key formations on said shaft engage said locking formations on said supporting structures of said grip base to prevent said grip body from pivoting relative to said grip base, said an unlocked position wherein said key formations on said shaft are disengaged from said locking formations on said supporting structures of said grip base allowing pivoting movement of said grip body and said shaft relative to said grip base, said shaft having a head portion at a rear end thereof and a tail portion at a front end thereof; and a spring captured between said head portion of said shaft and said grip body, said spring biasing said shaft to said normal locked position, said tail portion including a shoulder which engages with said grip body to restrict linear movement of said shaft against the bias of said spring, said shaft being linearly displaceable by selectively depressing said head portion of said shaft against the bias of the spring.

2. The firearm handgrip of claim 1, wherein said grip body has a normal center position in alignment with said grip base, and can pivot 30° about said central axis to either side relative to said grip base.

3. The firearm handgrip of claim 2, wherein said key formations and said locking formations are constructed and arranged to lock said grip body in said normal center position and a plurality of additional positions between said normal center position and said 30° rotation about said central axis.

4. The firearm grip of claim 1 wherein said tail portion of said shaft includes an inwardly threaded shank so as to form a barrel nut, and said head portion included an outwardly threaded shank which is received into said inwardly shank of said tail portion.

5. The firearm handgrip of claim 4, wherein said grip body has a normal center position in alignment with said grip base, and can pivot 30° about said central axis to either side relative to said grip base.

6. The firearm handgrip of claim 5, wherein said key formations and said locking formations are constructed and arranged to lock said grip body in said normal center position and a plurality of additional positions between said normal center position and said 30° rotation about said central axis.

* * * * *

UNITED STATES PATENT AND TRADEMARK OFFICE

CERTIFICATE OF CORRECTION

PATENT NO. : 8,601,734 B1
APPLICATION NO. : 13/743464
DATED : December 10, 2013
INVENTOR(S) : Charles Tyler Hopkins and Charles Anthony Hopkins It is certified that error appears in the above-identified patent and that said Letters Patent is hereby corrected as shown below:

Title Page, below Item (72) delete

"(73) Assignee: Alcor Scientific, Inc., Smithfield, RI (US)"

Signed and Sealed this
Eleventh Day of March, 2014

Michelle K. Lee

Michelle K. Lee
*Deputy Director of the United States Patent and Trademark Office*